United States Patent [19]

Murphy et al.

[11] 4,419,567

[45] Dec. 6, 1983

[54] HEATING ELEMENT FOR ELECTRIC WATER HEATER

[75] Inventors: Robert A. Murphy, Franklin; George L. Fehrmann, Nashville, both of Tenn.

[73] Assignee: Apcom, Inc., Franklin, Tenn.

[21] Appl. No.: 239,630

[22] Filed: Mar. 2, 1981

[51] Int. Cl.[3] ..... H05B 3/82; H01C 1/00; F24H 1/20

[52] U.S. Cl. ..... 219/336; 219/316; 219/318; 219/523; 338/229; 338/241; 338/333

[58] Field of Search ..... 219/316, 318, 335, 336, 219/523, 306, 312, 319, 320, 321, 338, 542, 526, 536, 437; 338/240, 241, 229, 230, 333

[56] References Cited

U.S. PATENT DOCUMENTS

| | | | |
|---|---|---|---|
| 2,446,555 | 8/1948 | Sage | 219/318 X |
| 2,533,615 | 12/1950 | Osterheld | 219/318 |
| 2,544,458 | 3/1951 | Higgins | 219/318 |
| 2,606,271 | 8/1952 | Morris | 219/316 X |
| 2,649,532 | 8/1953 | Woodman | 219/316 |

FOREIGN PATENT DOCUMENTS

| | | | |
|---|---|---|---|
| 625932 | 2/1936 | Fed. Rep. of Germany | 219/523 |
| 485273 | 5/1938 | United Kingdom | 219/335 |

*Primary Examiner*—A. Bartis

*Attorney, Agent, or Firm*—Michael, Best & Friedrich

[57] ABSTRACT

The heating element has an outer connector assembly including a cylindrical threaded portion adapted to be threaded into a boss on the heater water tank and a sheathed continuous electric resistance heating rod which has both ends secured to the connector assembly and which extends generally perpendicular to the heater tank centerline when installed. The heating rod is formed in a serpentine, generally W-shaped pattern with respect to the centerline of the cylindrical threaded portion, which provides the heating rod with an effective length greater than the inside diameter of the water tank, permits the heating rod to be inserted and withdrawn through the bore of the tank boss and permits the heater rod to be rotated, as the connector assembly is being threaded into and out of the tank boss, without striking any obstructions inside the water tank, such as the cold water dip tube, the hot water pipe and the anticorrosion anode. The heating rod is so bent that the portions between the ends thereof extend in the generally W-shaped pattern in first and second vertically spaced horizontal planes as either a single double W or a pair of double W's.

2 Claims, 3 Drawing Figures

HEATING ELEMENT FOR ELECTRIC WATER HEATER

BACKGROUND OF THE INVENTION

This invention relates to electric water heaters and, more particularly, to removable heating elements for electric water heaters.

Electric water heaters typically include one or more heating elements, each of which is threaded into a boss on the side of the water tank. The heating rod portion of the element usually extends generally straight and diametrically through the tank. Consequently, the length of the heating rod is limited by the inside diameter of the water tank.

Most conventional heating rods have a maximum wattage rating per square inch of surface area and operation at higher wattages significantly reduces life. Also, operational life of a heating rod having a given surface area can be increased by decreasing the wattage. Accordingly, in order to increase the operational life of the heating element, it is desirable to make the heating rod as long as possible with the constraints that the heating rod must fit through the tank boss for initial installation and replacement and the heating rod must not strike obstructions in the tank, such as the cold water dip tube, the anti-corrosion anode and the hot water outlet pipe, while being rotated as the heating element is being threaded into or unthreaded from the tank boss.

SUMMARY OF THE INVENTION

One of the principal objects of the invention is to provide a heating element for electric water heaters having an increased operational life.

Another principal object of the invention is to provide a heating element for electric water heaters including a heating rod which has an effective length greater than the inside diameter of the water tank and yet can be inserted and withdrawn through a boss in the tank and rotated inside the water tank during installation and/or removal without striking internal obstructions.

Other objects, aspects and advantages of the invention will become apparent to those skilled in the art upon reviewing the following detailed description, the drawing and the appended claims.

The heating element provided by the invention has an outer connector assembly including a cylindrical portion adapted to be threaded into a bored boss on the heater tank and carrying a pair of electrical terminals and a sheathed electrical heating rod having at least one end secured to the connector assembly. The heating rod preferably extends generally perpendicularly to the centerline of the heater tank when installed and extends from the connector assembly in a serpentine pattern which provides the heating rod which an effective length greater than the inside diameter of the heater tank, permits the rod to be inserted through the bore of the tank boss and permits the heating rod to be rotated about the longitudinal axix of the tank boss, as the connector assembly is being threaded into or out of the tank boss, without any portion of the rod striking any obstructions inside the tank. The preferred heating rod pattern is generally W-shaped.

DESCRIPTION OF THE PREFERRED EMBODIMENTS

Figure 1:
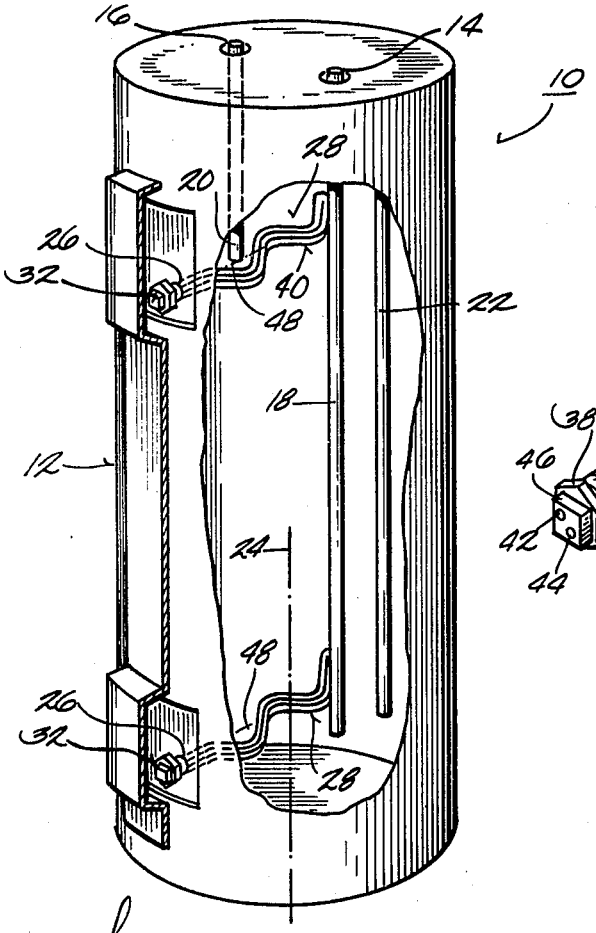
FIG. 1 is a perspective, partially broken away view of an electric water heater including a pair of heating elements embodying the invention.

Illustrated in the drawing is an electric water heater 10 including a cylindrical tank 12, a cold water inlet fitting 14 and a hot water outlet fitting 16 on the top of the tank 12, a cold water pipe or dip tube 18 connected to the inlet fitting 14 and extending inside the tank 12, a combination hot water pipe and anode 20 connected to the outlet fitting 16 and extending into the tank 12, and a conventional anode 22 inside the tank 12 for minimizing corrosion. The dip tube 18, combination hot water pipe and anode 20 and the anode 22 all extend vertically and generally parallel to the longitudinal axis or the centerline 24 of the tank 12.

Located on the side of the tank 12 is a pair of vertically spaced bosses 26 (one shown in detail in FIG. 3) for removably receiving a heating element 28. Each boss 26 has a bore 30 including a threaded portion 31.

Eeach heating element 28 has an outer connector assembly 32 which has a hollow body 34 including a cylindrical threaded portion 36 adapted to be threaded into the boss 26 and a flat-sided, enlarged head portion 38 adapted to receive a wrench for tightening and loosening. Each heating element 28 has a sheathed heating rod 40 which is of conventional construction except for the geometry described below.

The opposite ends of the heating rod 40 extend into the connector assembly body 34 and are suitably secured thereto in a water tight manner. The heating rod 40 includes an internal electrical resistor (not shown) extending therethrough and the opposite ends of the resistor are connected to electrical terminals 42 and 44 on a terminal block 46 suitably secured to the connector assembly head 38. When the heating element 28 is installed in the boss 26, the heating rod 40 preferably extends generally pependicularly to the tank centerline 24 as best shown in FIG. 3.

In accordance with the invention, the effective length of the heating rod 40 is increased by forming it in a serpentine pattern with respect to the centerline or longitudinal axis 48 of the threaded portion 36 of the connector assembly 32. This axis is coincident with the longitudinal axis of the tank boss bore 36 which extends perpendicularly to the tank centerline 24. The serpentine pattern is geometrically arranged so that the heating rod 40 can be "snaked" through the tank boss bore 30 for installation and removal. The serpentine pattern is also arranged so that the heating rod 40 can be rotated about the axis 48, as the connector assembly 32 is being threaded into or unthreaded from the tank boss 26, without any part of the heating rod 40 striking the dip tube 18, the combination hot water pipe and anode 20 or the anode 22. While various serpentine patterns for the heating rod 40 can be used as long as the above requirements are met, the preferred shape is a smoothly curved W or a sinusoidal-like wave as illustrated.

With this arrangement, the curved or effective length of the heating rod 40 can be substantially greater than the inside diameter tank. This increase in length affords an increase in the operational life for a given wattage over conventional straight heating rods which, of course, must be somewhat shorter than the inside diameter of the tank. Also, the longer length of the heating rod 40 and, thus, increased surface area, permits the wattage to be increased without reducing operational life.

Figure 3:
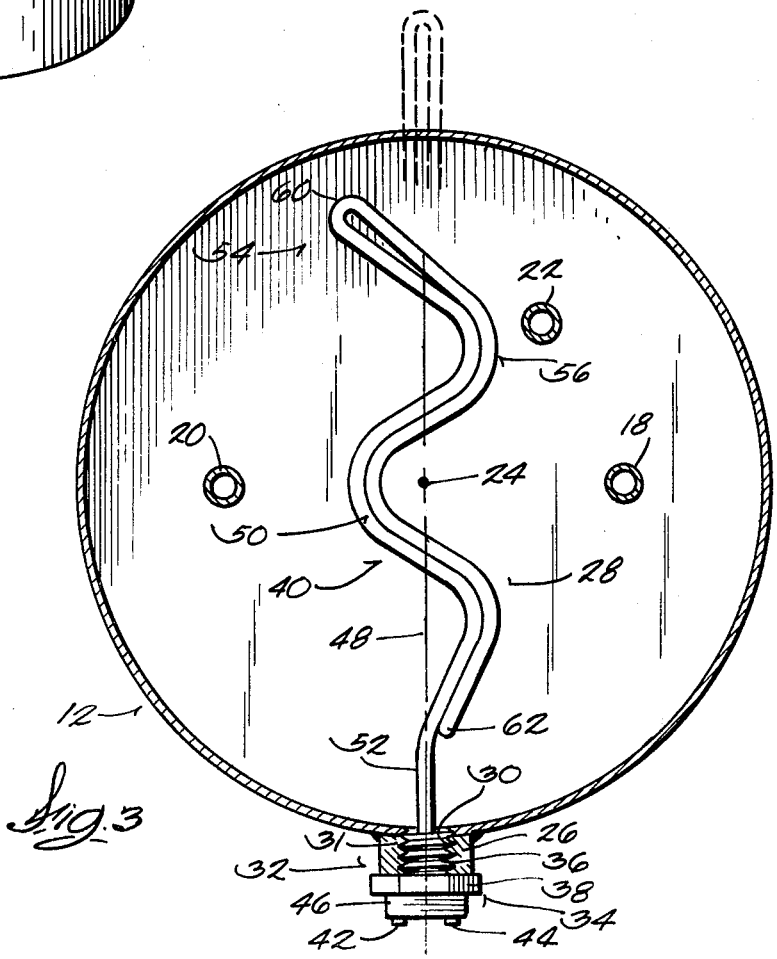
FIG. 3 is a top plan sectional view of the water heater in FIG. 1.

The increased effective length of a heating rod arranged in accordance with the invention is illustrated in FIG. 3. For a tank having a 14-inch inside diameter, the heating rod formed with a serpentine pattern according to the invention can have an effective length of approximately 16½ inches or more even though the actual length or distance it extends from the tank is approximately 13 inches or less. To have the same effective length, a conventional straight heating rod would have to be substantially longer than the inside diameter of the tank 12 as illustrated by dashed lines.

Figure 2:
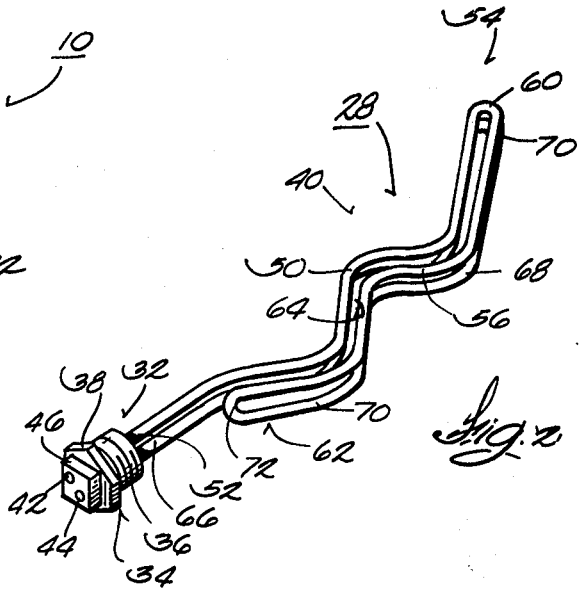
FIG. 2 is a perspective, partially diagrammatic, view of the heating element.

In the specific construction illustrated, the heating rod 40 is a continuous member and is formed into a pair of double W's. That is, referring to FIG. 2, the heating rod 40 includes a first double W section including a first section 50 which has one end 52 secured to the connector assembly 32 and extends, through a first generally horizontal plane and through a W pattern, between the connector assembly and an outer end location 54. The first W segment further includes a second section 56 which has one end integrally connected to the first section 50 through a bend 60 of about 180° and extends, through the first plane, through a W pattern and in close proximity to the first section 50, between the outer end location 54 and an inner end location 62.

The heating rod 40 also has a second double W segment including a third section 64 which has one end 66 secured to the connector assembly 32 and extends, through a second generally horizontal plane spaced from the first plane vertically and through a W pattern, between the connector assembly and the outer end location 54. The second double W segment further includes a fourth section 68 which has one end integrally connected to the second section 56 through a bend 72 of about 180° and extends, through the second plane, through a W pattern and in close proximity to the third section 64, between the inner end location 62 and the outer end location 54. The outer end of the fourth section 68 is integrally connected with the third section 64 through a bend 70 of about 180°.

For heating elements with lower wattage requirements, the heating rod 40 can be formed with a single double W. That is, the heating rod 40 can be formed with only a section 50 and a section 64 which are integrally connected together through a bend at the outer end.

From the foregoing description, one skilled in the art can easily ascertain the essential characteristics of this invention and, without departing from the spirit and scope thereof, make various changes and modifications to adapt it to various usages.

We claim:

1. A heating element for an electric heater including a generally cylindrical tank, a threaded, bored boss on the water tank for receiving a heating element, and one or more obstructions extending inside the tank generally parallel to the tank centerline, said heating element comprising an outer connector assembly including a cylindrical portion adapted to be threaded into the tank boss; and a sheathed electrical heating rod including a continuous member which has opposite ends secured to said connector assembly, extends generally perpendicularly to the tank centerline when installed, and is formed in a generally W-shaped pattern with respect to the centerline of said connector cylindrical portion to thereby provide said heating rod with an effective length greater than the inside diameter of the tank, to permit said heating rod to be inserted and withdrawn through the bore of the tank boss and to permit said heating element to be rotated about the centerline of said connector threaded portion, as said connector assembly is being threaded into or out of the tank boss, without any portion of said heating rod striking any of the obstructions inside the tank, one portion of said member extending in a first generally horizontal plane and in said pattern between said connector and a location remote from said connector and another portion of said member extending in a second generally horizontal plane vertically spaced from said first plane and in said pattern between said connector and said remote location.

2. The heating element according to claim 1 wherein said member includes a first segment having a first section which has an end secured to said connector and extends between said connector and an outer end location in said first plane and in said pattern and a second section which is integrally connected with said first section through a bend of about 180° and extends between said outer end location and an inner end location spaced from said connector in said first plane, in said pattern, and in close proximity to said first section; and a second segment having a third section which has an end secured to said connector and extends between said connector and said outer location in said second plane and in said pattern and a fourth section which is integrally connected with said third section through a bend of about 100° and extends between said outer end location and said inner end location in said second plane, in said pattern, and in close proximity to said third section, said fourth section being integrally connected to said third section through a bend of about 180°.

* * * * *

UNITED STATES PATENT AND TRADEMARK OFFICE

CERTIFICATE OF CORRECTION

PATENT NO. : 4,419,567

DATED : December 6, 1983

INVENTOR(S) : Robert A. Murphy and George L. Fehrmann

It is certified that error appears in the above—identified patent and that said Letters Patent is hereby corrected as shown below:

Column 1, Line 59, after "rod" and before "an" delete "which" and substitute therefor ---with---

Line 63, after "longitudinal" and before "of" delete "axix" and substitute therefor ---axis---

Column 2, Line 29, before "heating" delete "Eeach" and substitute therefor ---Each---

Column 3, Line 37, after "plane" and before "spaced" insert ---vertically---

Line 38, after "plane" and before "and" delete ---vertically---

Signed and Sealed this

*Seventeenth* Day of *April 1984*

[SEAL]

*Attest:*

GERALD J. MOSSINGHOFF

*Attesting Officer*

*Commissioner of Patents and Trademarks*